US005725117A

United States Patent [19]

Berjis

[11] Patent Number: 5,725,117

[45] Date of Patent: Mar. 10, 1998

[54] APPARATUS FOR FORMING A CONTAINER TO HOLD A DRINKING CUP AT THE BOTTOM END OF THE CONTAINER AND TO HOLD FOOD IN THE UPPER PORTION OF THE CONTAINER

[75] Inventor: Pejman Berjis, Beverly Hills, Calif.

[73] Assignee: Devine Holdings, LLC, Los Angeles, Calif.

[21] Appl. No.: 656,012

[22] Filed: May 24, 1996

Related U.S. Application Data

[63] Continuation-in-part of Ser. No. 329,227, Oct. 26, 1994, Pat. No. 5,573,131.

[51] Int. Cl.[6] ..... B65D 21/32

[52] U.S. Cl. ..... 220/4.03; 220/531; 220/503; 220/710

[58] Field of Search ..... 220/521, 531, 220/528, 527, 503, 505, 529, 4.03, 4.01, 710, 709, 705, 729, 694, 23.83, 23.86; 215/6; 206/501; 229/120.13, 120.19, 120.23

[56] References Cited

U.S. PATENT DOCUMENTS

| | | | |
|---|---|---|---|
| 140,919 | 7/1873 | Hawkins | 220/521 |
| 512,109 | 1/1894 | Hinman . | |
| 781,053 | 1/1905 | DeVore . | |
| 1,665,289 | 4/1928 | Weaver . | |
| 3,288,344 | 11/1966 | Woolen et al. . | |
| 4,429,789 | 2/1984 | Puckett, Jr. | 220/527 |
| 4,714,173 | 12/1987 | Ruiz . | |
| 4,811,860 | 3/1989 | Sorenson et al. . | |
| 4,938,373 | 7/1990 | McKee | 220/23.86 |
| 4,955,528 | 9/1990 | Schluckebiev | 229/120.18 |
| 5,050,759 | 9/1991 | Marble . | |
| 5,180,079 | 1/1993 | Jeng . | |
| 5,277,312 | 1/1994 | Vumbaca | 220/531 |
| 5,388,729 | 2/1995 | Gerringer . | |
| 5,402,910 | 4/1995 | Pilney . | |

FOREIGN PATENT DOCUMENTS

| | | | |
|---|---|---|---|
| 2649080 | 1/1991 | France | 220/710 |
| 1175582 | 12/1969 | United Kingdom | 220/709 |

*Primary Examiner*—Stephen J. Castellano
*Attorney, Agent, or Firm*—Thomas I. Rozsa; Tony D. Chen

[57] ABSTRACT

An apparatus for forming a unitary container to hold a drinking cup at the bottom end of the container and to hold food in the upper portion of the container. The container is generally a frusto-conical shaped structure such that a person can have one hand unoccupied while the other hand holds the container which retains both the drinking cup and the food therein.

15 Claims, 8 Drawing Sheets

APPARATUS FOR FORMING A CONTAINER TO HOLD A DRINKING CUP AT THE BOTTOM END OF THE CONTAINER AND TO HOLD FOOD IN THE UPPER PORTION OF THE CONTAINER

This application is a continuation-in-part of patent application Ser. No. 08/329,227 filed on Oct. 26, 1994, now U.S. Pat. No. 5,573,131.

BACKGROUND OF THE INVENTION

1. Field of the Invention

The present invention generally relates to the field of cup attachments. More particularly, the present invention relates an apparatus for retaining paper or plastic cups used to hold drinks to the bottom end of the apparatus and to hold food in the upper portion of the apparatus.

2. Description of the Prior Art

Snacking foods and refreshments are sold at many establishments such as restaurants, movie theatres, concert halls, sports stadiums, convenience stores, amusement parks, and theme parks. Many people usually buy a refreshment like water, soft drink, or juice along with a snacking food like pretzels, popcorn, french fries, or potato chips. Even though these items are bought together, they are sold in two separate containers. This is not very convenient for a person who has to use both hands to carry both items. It would be more convenient to have one container which could carry both items. Many establishments have employed the use of cardboard trays which hold many of these items together; and yet, this is only useful from the place of purchase to the destination. After that the tray is of no use.

At the movies, as an example, one usually purchases a paper bag or a paper cup of popcorn and a paper cup of refreshment. After this purchase, one needs to carry both items as well as one's coat and movie tickets towards the entrance where an attendant checks the tickets. The procession continues towards the movie theatre where one needs to push the door open while carrying all of these items in both hands. After reaching the theatre seats, one needs to pull down the seat in order to sit down. As it can be seen, it is very difficult to handle all of these items while trying to do other tasks. Because of this problem, people tend to spill the beverage and the popcorn onto the ground; they also walk slower, trying not to spill anything, which frustrates and slows down the traffic coming from behind.

When the movie starts, it is very dark and it is very hard to see anything. It is not convenient to hold both a bag or cup of popcorn and a drink while watching a movie. For this reason many people place one of the items in front of their seat and on the ground, which makes it easy to spill since nobody can see it in the dark. Some theatres have placed a cupholder on the seat armrest; but unfortunately, this only holds one item at a time. Because of this, many people place their cups on the ground. One problem which this imposes is that people repeatedly bend down and up, to get their popcorn and place it back again. To the people sitting behind, this is very annoying since it interrupts their watching the movie. It would be easier to hold a combined container, of the two cups, which separately contains both the drink and the popcorn: both items are always in close proximity to the other so that one can consume both items at the same time. Also, one can carry both items in one hand at all times while the other hand is empty to perform other tasks. Further, it is not necessary to move around placing the snacks in different areas, there is less of a chance of spillage, and one can enjoy the snacks as well as the movie without interrupting anyone in the theatre.

The following seven (7) prior art patents were uncovered in the pertinent field of the present invention:

1. U.S. Pat. No. 512,109 issued to Hinman on Jan. 2, 1894 for "Milk Can" (hereafter "the Hinman Patent");

2. U.S. Pat. No. 1,665,289 issued to Weaver on Apr. 10, 1928 for "Means For Serving Food And Drink" (hereafter "the Weaver Patent");

3. U.S. Pat. No. 4,714,173 issued to Ruiz on Dec. 22, 1987 for "Leak-proof Closures" (hereafter "the Ruiz Patent");

4. U.S. Pat. No. 4,811,860 issued to Sorenson et al. on Mar. 14, 1989 for "Nestable Disposable Drinking Receptacles" (hereafter "the Sorenson Patent");

5. U.S. Pat. No. 5,050,759 issued to Marble on Sep. 24, 1991 for "Infant Drinking Cup" (hereafter "the Marble Patent");

6. U.S. Pat. No. 5,180,079 issued to Jeng on Jan. 19, 1993 for "Combined Cup" (hereafter "the Jeng Patent"); and 7. U.S. Pat. No. 5,402,910 issued to Pilney on Apr. 4, 1995 for "Container Having Ladder Attachable Handle" (hereafter "the Patent").

The Hinman patent discloses a milk can. It comprises a can and a hollow plug for plugging the can. The hollow plug is threadedly engaged with a screw which projects upward from the bottom of the can. The hollow plug receives ice which is held within the plug and which keeps the milk in the can cool.

The Weaver Patent discloses a means for serving food and drink. It comprises a cup and a dish which is shaped to extend into the upper part of the cup and to seat loosely on the rim of the cup.

The Ruiz Patent discloses a leak-proof closure. It comprises a cover for openings of containers wherein the cover may include a one-way valve mechanism to be made of a porous material that allows air through but not liquid. An orifice with a tubular extension attached thereto provides a suitable engagement with a straw that is used to withdraw the liquid contained in the cup.

The Sorenson Patent discloses nestable disposable drinking receptacles. It comprises a straw which is integrally formed with a cup or cup lid.

The Marble Patent discloses an infant drinking cup with a specialized type of lid which includes a spout for enabling an infant to drink through the cup.

The Jeng Patent discloses a combined cup. It comprises an upper cup body and a lower cup body jointed together by a connecting body from between to contain solid snacks and drink. A nozzle extends upward to be received into the nozzle sleeve formed on the upper cup body so as to keep both cup bodies firmly connected. A straw is then inserted into the nozzle for drinking liquid from the lower cup body.

The Pilney Patent discloses a container having a ladder attachable handle. It comprises a receptacle with a bottom wall and upstanding side and end walls defining an open upper end adapted to receive a lid. The receptacle forms a leak proof receptacle and has a lateral width and transverse depth sufficient to receive utility tools. A U-shaped handle is pivotally connected to the upstanding end walls and has a substantially horizontal hanging bar enabling releasable attachment to a step of a stepladder so that the receptacle is maintained in an upright position by gravity.

It is desirable to have a very efficient and also very effective design and construction of an apparatus for forming a container to retain a drinking cup at the bottom end of the container and to retain food in the upper portion of the container, where both the drinking cup and the food are retained by the apparatus.

SUMMARY OF THE INVENTION

An object of this invention is to provide a cup attachment which attaches to the top of a drinking cup; this unit on top will hold snacking foods. As a result, the regular drinking cup can now hold both a drink in the cup and a snacking food on the top of it at the same time.

The present invention is a novel and unique apparatus for forming a container to hold a drinking cup at the bottom end of the container and to hold food in the upper portion of the container. The container is generally a frusto-conical shaped structure.

It has been discovered, according to the present invention, that by providing an apparatus which forms a container to hold a drinking cup or the like at the bottom end of the container and to hold food in the upper portion of the container, then a person has one hand that is unoccupied while the other hand holds the apparatus which retains both the drinking cup and the food.

It is therefore an object of the present invention to provide an apparatus which forms a container to hold a drinking cup or the like at the bottom end of the container and to hold food in the upper portion of the container, so that a person can have one hand unoccupied while the other hand holds the apparatus which retains both the drinking cup and the food therein.

In the new embodiment of the present invention, the apparatus is a unitary structure.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

Figure 1A:
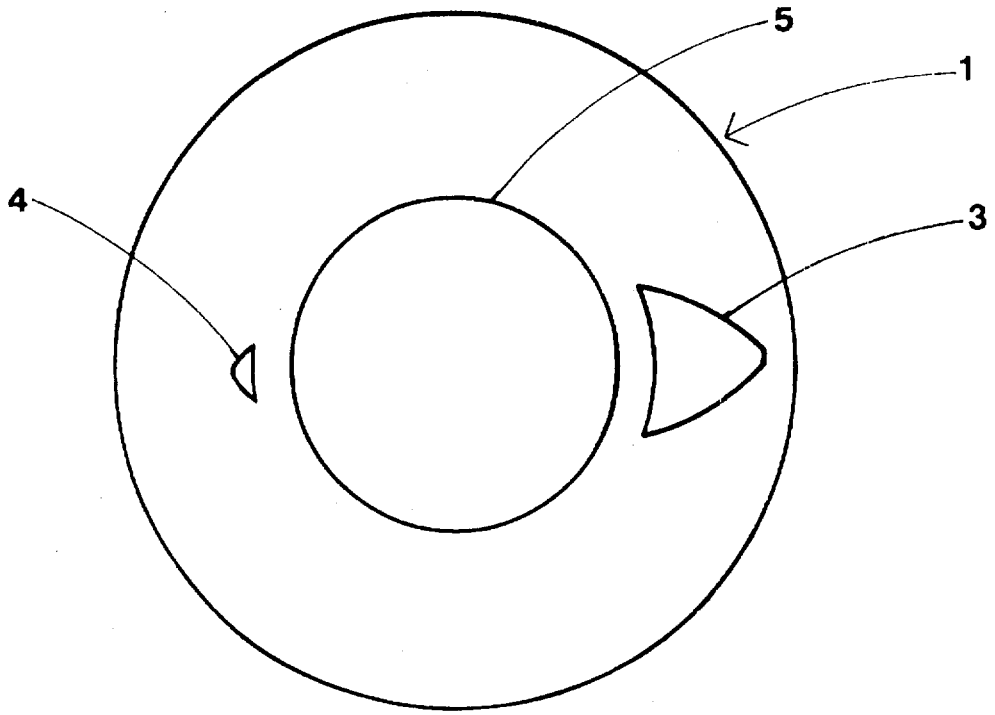
FIG. 1*a* is a top view of the conal container attachment showing the two openings on the conal container attachment wall.

REFERENCE NUMERALS 1. conal container attachment
2. locking device
3. long opening
4. short opening
5. bottom opening
6. notch
7. ridges
8. cup and lid assembly
9. straw

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1B:
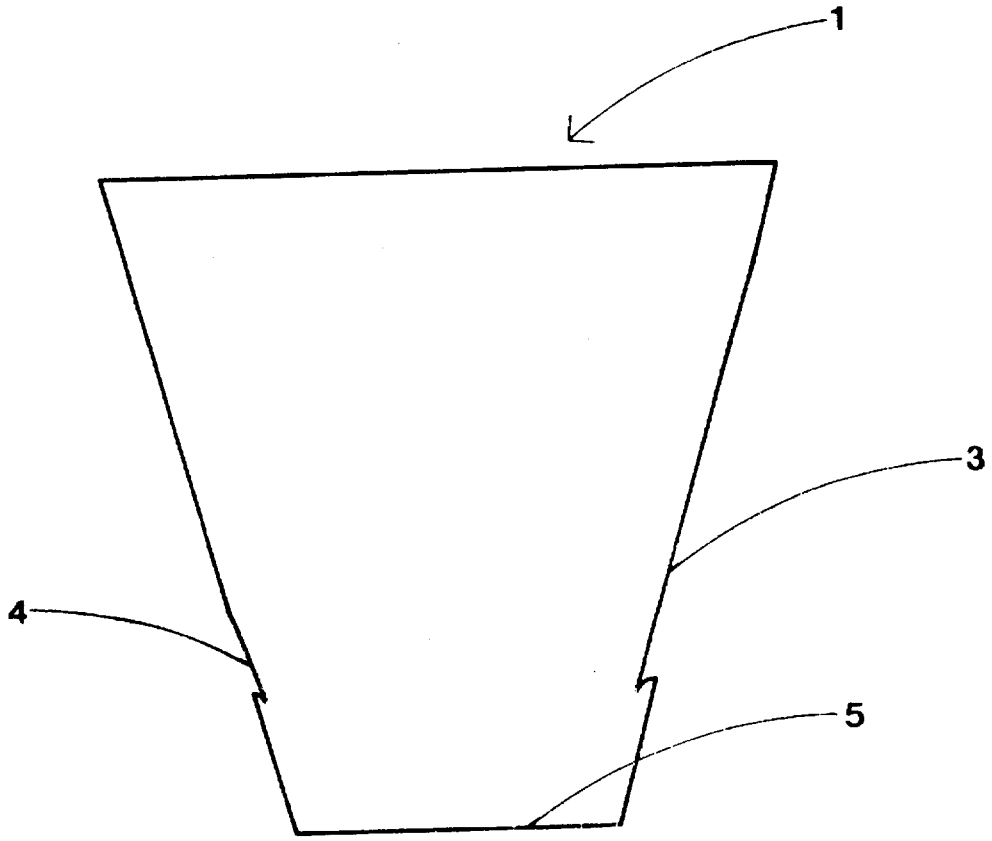
FIG. 1B is an elevation of the conal container attachment showing the two openings of the conal container attachment from the side view.
Figure 2A:
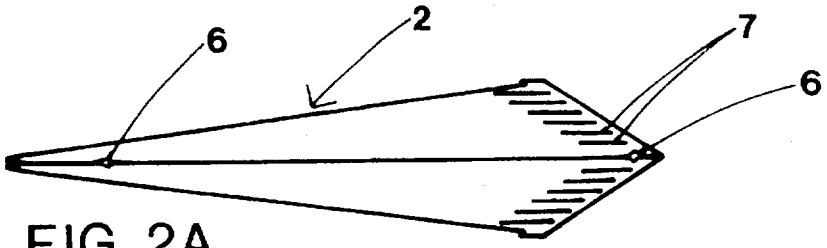
FIG. 2A is the top view of the locking device.
Figure 2B:
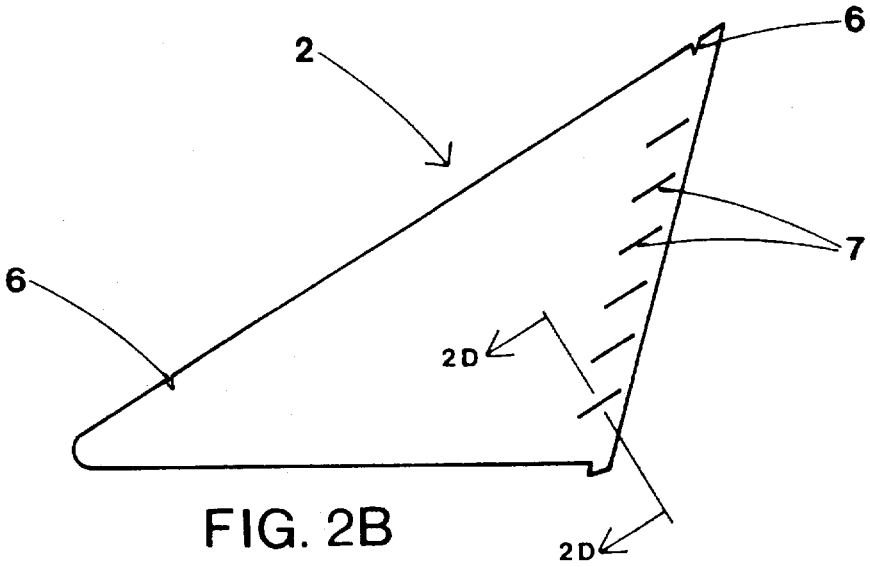
FIG. 2B is the side view of the locking device.
Figure 2C:
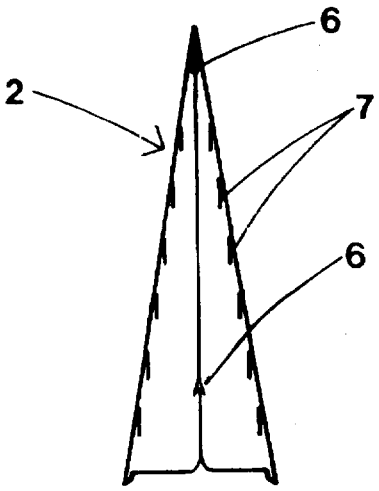
FIG. 2C is the front view of the locking device.
Figure 2D:
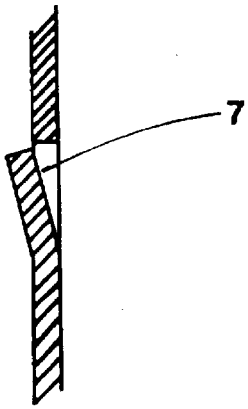
FIG. 2D is a detail of a typical ridge on the side of the locking device.

Referring to FIG. 1A and 1B, a conal container attachment 1 is shown comprised of a long wall opening 3, a short wall opening 4, and a bottom opening 5.

Referring to FIG. 2A to 2D, a locking device 2 is shown comprised of notches 6 and ridges 7.

Figure 3:
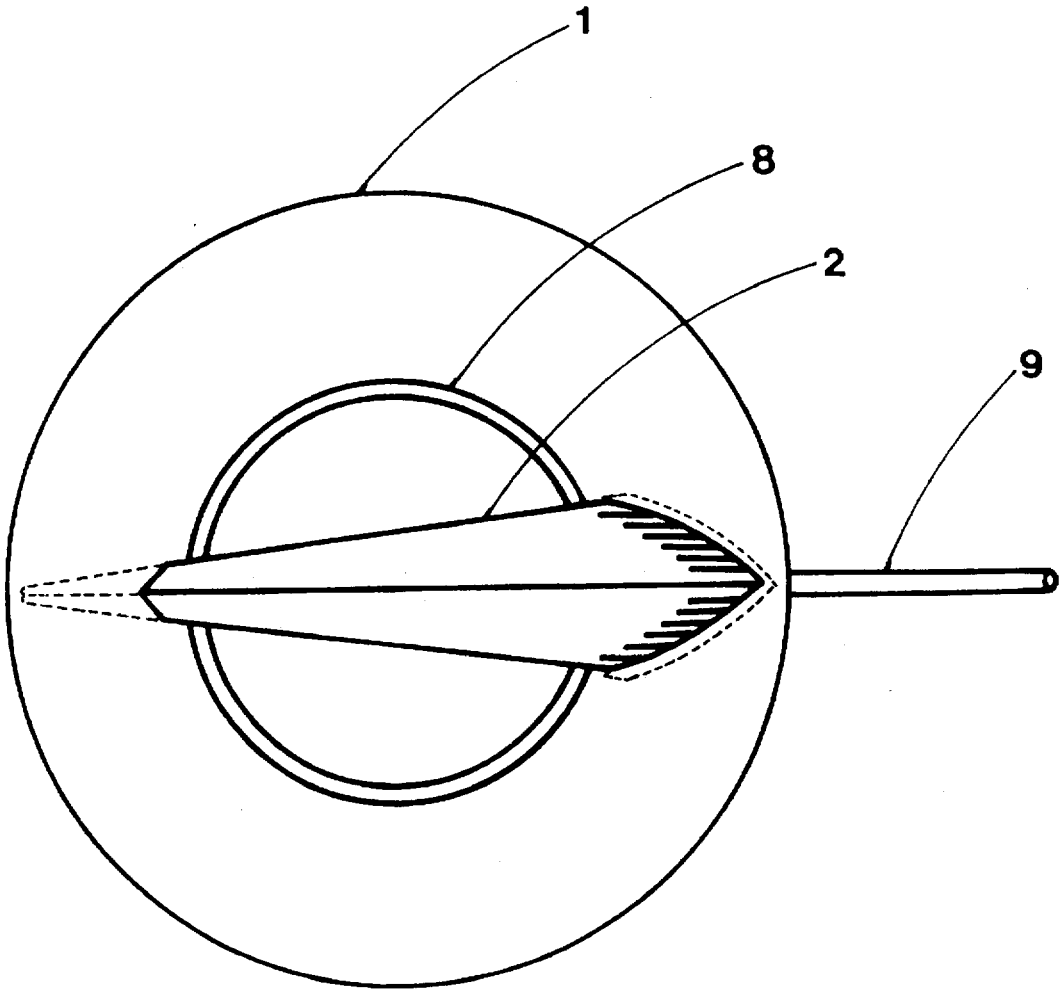
FIG. 3 is a top view of a full assembly of the cup attachment attached to a softdrink cup. The assembly shows the conal container attachment and the locking device attached to the top of the cup with a straw fitting into the cup from the side of the cup attachment.

FIG. 3 shows the present invention in full assembly attached to a cup lid assembly 8 with a straw 9 put into cup and lid assembly 8 from the side of the cup attachment.

Figure 4:
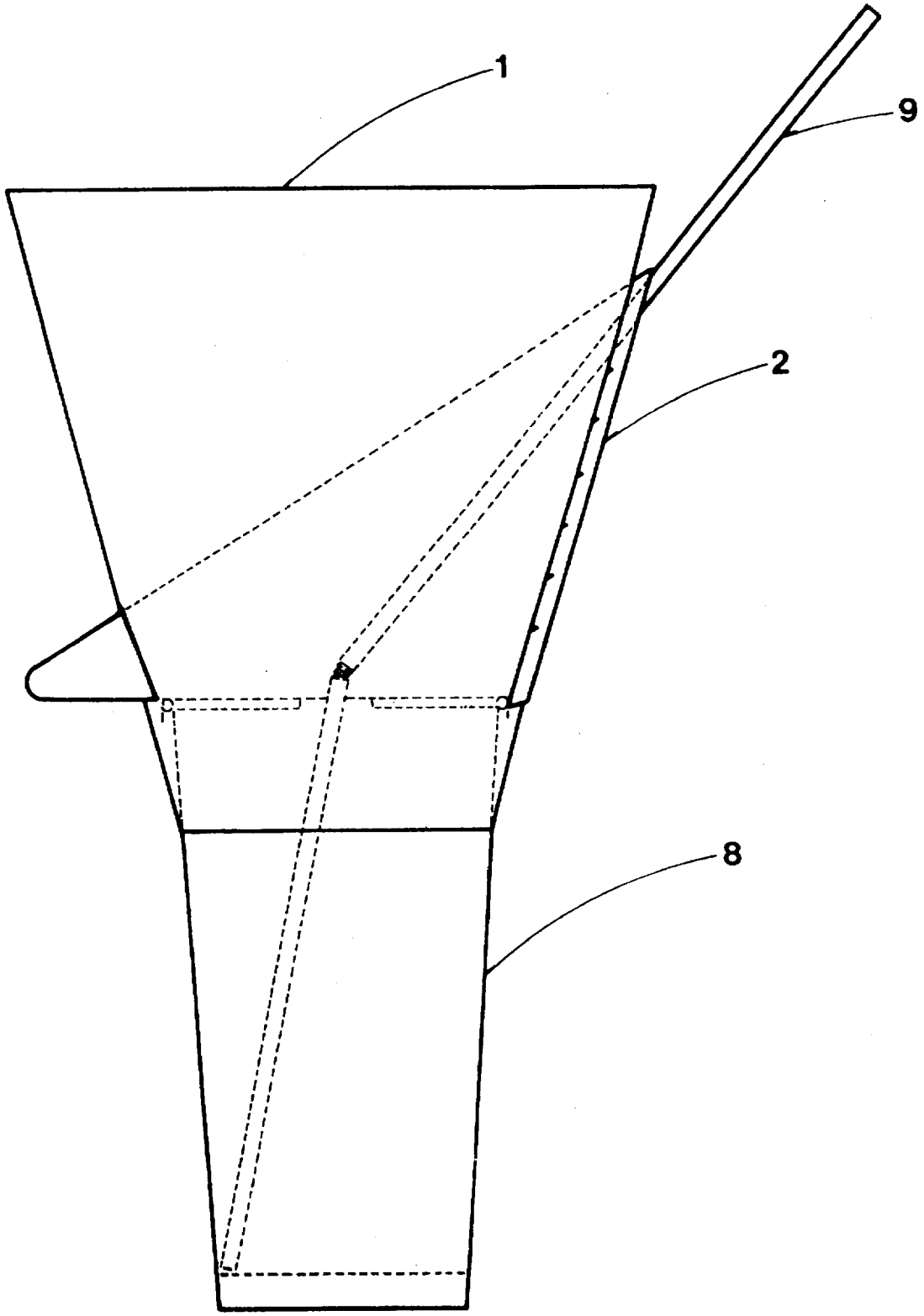
FIG. 4 is the side view of a full assembly of the cup attachment attached to a softdrink cup with a straw fitting into the cup from the side of the cup attachment.
Figure 5:
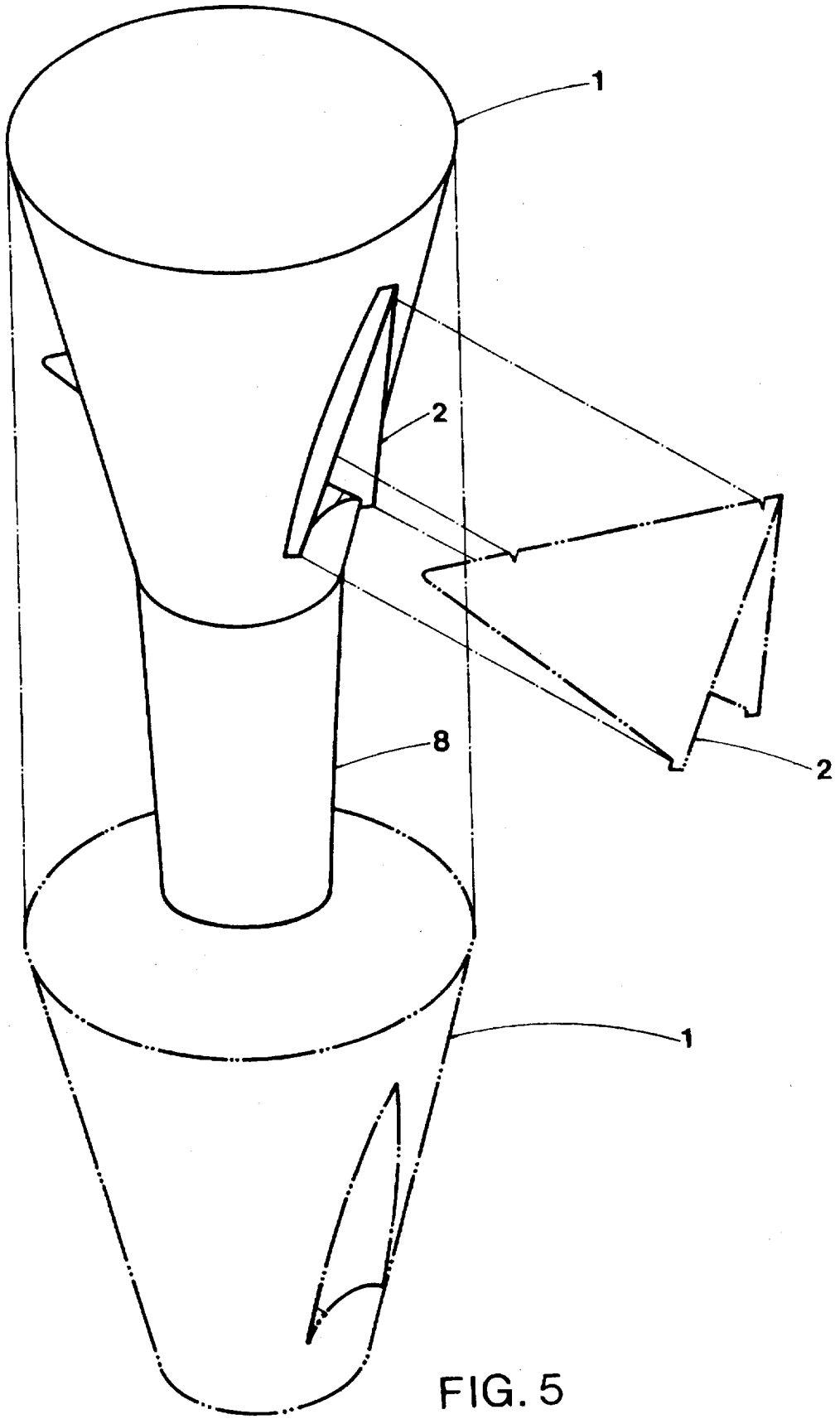
FIG. 5 is an isometric view of the invention in full assembly. This view shows the locking device and the conal container attachment before they come together to lock at the top of the cup and lid assembly.

FIG. 4 shows the full assembly of the present invention attached to a cup filled with a softdrink. In assembling the cup attachment to cup and lid assembly 8, one will first fill the paper cup with a consumable drink, and close it with a lid typically made of styrene or some other kind of plastic. Then this cup and lid assembly 8 is placed into conal container attachment 1, where one pulls conal container attachment 1 upwards as shown in FIG. 5. When cup and lid assembly 8 lifts off the ground with conal container attachment 1, bottom opening 5 holds on to the upper portion of cup and lid assembly 8 momentarily by ways of friction. When this is done, one inserts locking device 2 into long opening 3 and through to short opening 4, where locking device 2 locks into conal container attachment 1 by ways of notches 6 snapping into the wall of conal container attachment 1, as shown in FIG. 4. Now the present invention in full assembly creates an enclosed container on the top of cup and lid assembly 8. This top container now is ready to be filled with a snacking food like popcorn. The space created between locking device 2 and cup and lid assembly 8 can be used to insert straw 9 into creased opening of the lid of the cup in order to reach the softdrink.

Ridges 7 on both sides of locking device 2 create a barrier on long opening 3 where liquids like melted butter for popcorn is directed towards the middle of the container by ways of ridges 7 which are slanted downwards into the container. This system of ridges 7 will keep excess liquids from flowing out of the top container through long opening 3.

Figure 6:
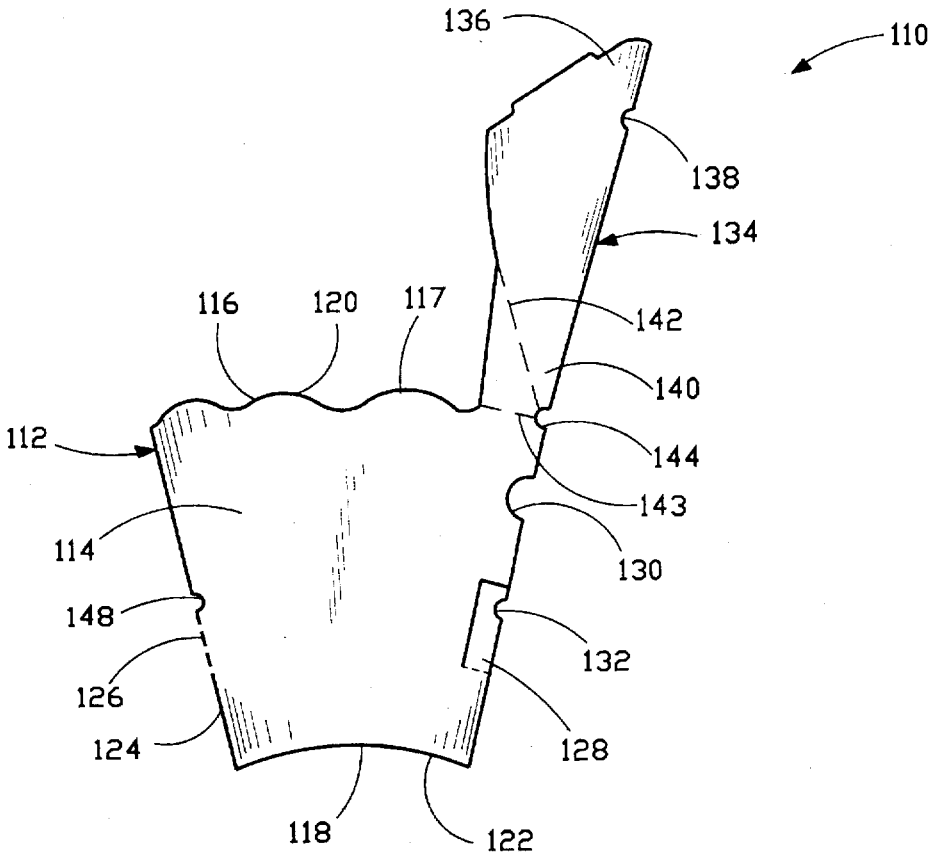
FIG. 6 is a side elevational view of another embodiment of the present invention apparatus for forming a container to retain a drinking cup and food therein.
Figure 7:
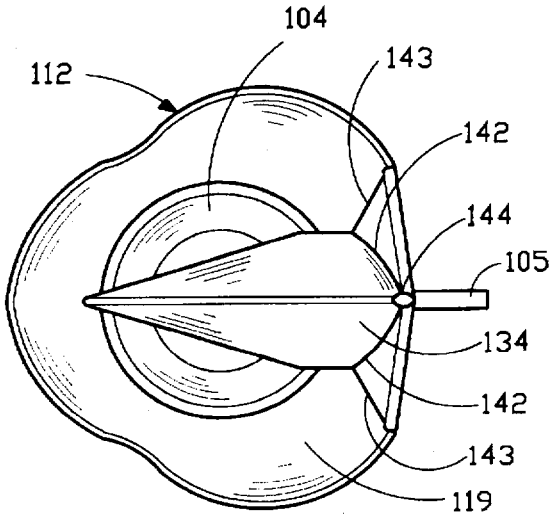
FIG. 7 is a top plan view of the present invention apparatus retaining a drinking cup at the bottom end of the container.

Referring to FIGS. 6 and 7, FIG. 6 is a side elevational view of the present invention apparatus 110 in its unformed or unassembled flat condition, and FIG. 7 is a top plan view of the present invention apparatus 110 in its formed condition. A conventional drinking cup 100 (see FIG. 8) is located at the bottom end of the apparatus 110. The apparatus 110, when it is unfolded forms a container 112 to retain food and used in conjunction with the drinking cup 100 which retains liquid therein. After use, the apparatus 110 is disposable. A conventional removable lid 104 covers the top opening on the drinking cup 100 for retaining the liquid therein. The lid 104 has an opening through which a straw 105 can be inserted for drinking the liquid.

Referring to FIGS. 6 through 10, the container 112 has a generally frusto-conical shaped body 114 which has a widened end 116 and a narrow end 118. The widened end 116 forms a periphery wavy lip 117 and has a wide opening 120, whereas the narrow end 118 has a narrow opening 122. The widened end 116 is typically formed of a wavy lip 117, as illustrated, but it is understood that the periphery lip 117 may be a continuous annular lip. A hollow chamber 119 is formed and located between the wide opening 120 at the widened end 116 and the narrow opening 122 at the narrow end 118. The frusto-conical shaped body 114 further has a circumferential shaped sidewall 124. The circumferential shaped sidewall 124 has a slotted aperture 126 located adjacent to the narrow end 118, a fold-down flap 128 which is provided and located opposite the slotted aperture 126, and an aperture 130 which is located adjacent to the widened end 116 and above the fold-down flap 128 for the straw 105 to be inserted therethrough. The fold-down flap 128 has an aperture 132 therethrough. The fold-down flap 128 may be folded down after the drinking cup 100 is installed within the frusto-conical shaped body 114. Once the fold-down flap 128 is folded down, a rectangular shaped hole 146 is established. The fold-down flap 128 will be parallel to the lid 104, where the aperture 132 on the fold-down flap 128 provides a directing device for the straw 105 to be inserted to the opening on the lid 104.

It will be appreciated that the present invention apparatus 110 may be manufactured without the fold-down flap 128 such that the circumferential shaped sidewall 124 of the frusto-conical shaped body 114 has a rectangular shaped opening 146 which can be used for holding candy bars or like. It will be also appreciated that dashed lines 145 and 147 are crease lines so that the apparatus 110 can be folded in the flat condition for shipping and storage. It is emphasized that while the dashed lines 145 and 147 are provided with the apparatus 110, it is also within the spirit and scope of the present invention to manufacture the apparatus without these crease lines.

Figure 8:
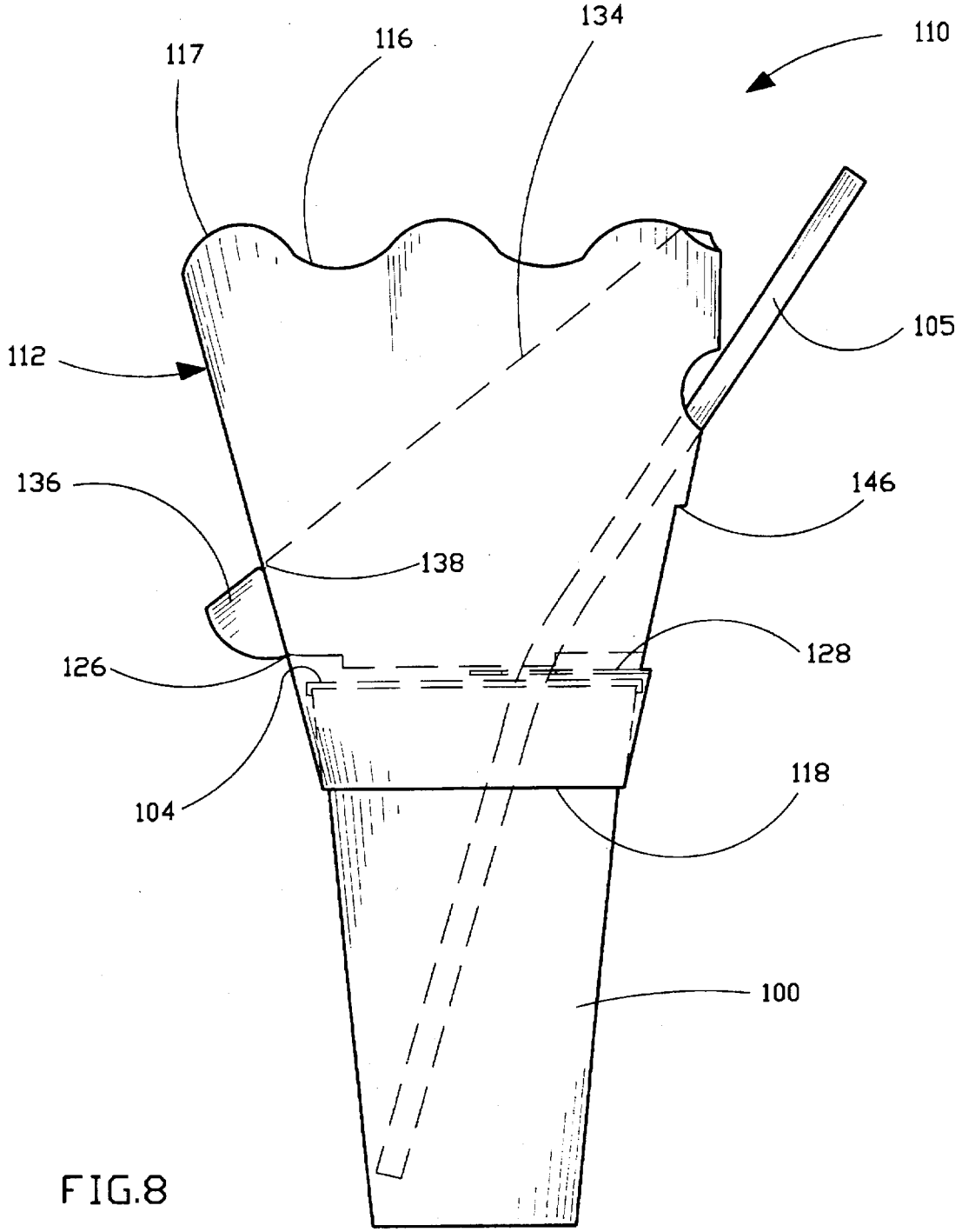
FIG. 8 is a side elevational view of the present invention apparatus which forms a container to hold a drinking cup at the bottom end of the container, where the upper portion can retain food.
Figure 9:
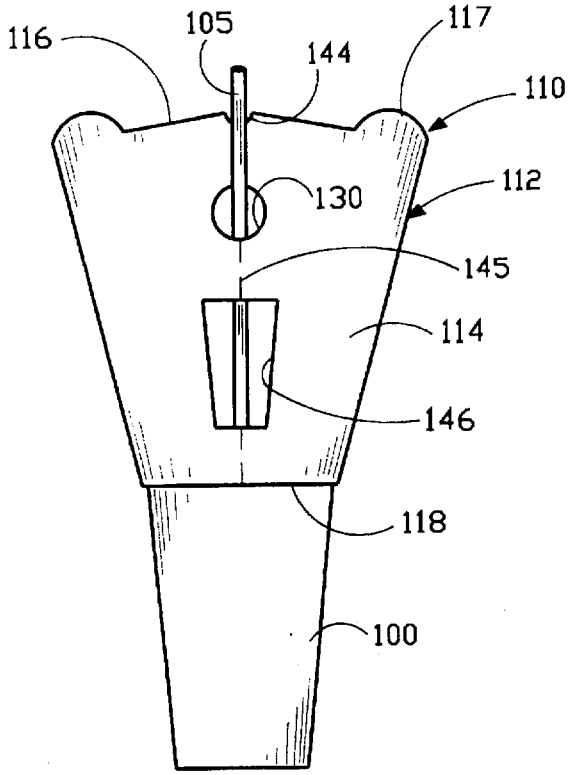
FIG. 9 is a side elevational view of the present invention apparatus, showing the back side of the apparatus.
Figure 10:
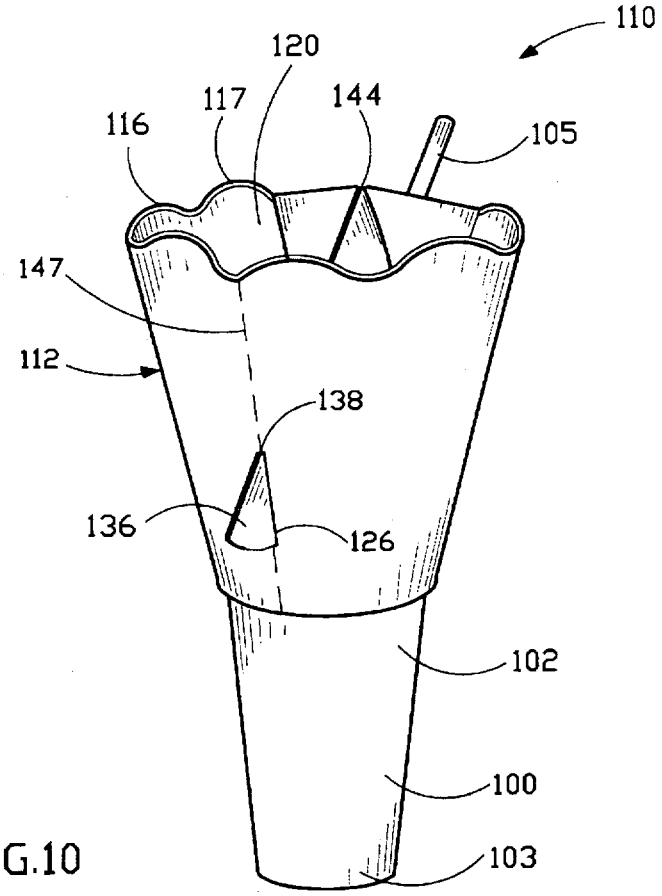
FIG. 10 is a perspective view of the present invention apparatus.

Referring to FIGS. 6, 7 and 8, there is shown an elongated flap or panel 134 which has a first end 136 and a second end 140. The first end 136 has a notch 138. The second end 140 is integrally formed with the periphery wavy lip 117 of the frusto-conical shaped body 114. The flap 134 is assembled by folding on the dotted lines 142 and 143 which are provided on both sides of the flap 134 (see FIG. 7). A hole 144 is provided between the second end 140 of the flap 134 and the widened end 116 of the frusto-conical shaped body 114 so that the flap 134 is easily folded down within the frusto-conical shaped body 114. Once the flap 134 is folded downwardly into the hollow chamber 119 of the frusto-conical shaped body 114, the first end 136 of the flap 134 is inserted into the slotted aperture 126 on the sidewall 124 of the frusto-conical shaped body 114 and secured therein by the notch 138 which latches the slotted aperture 126 thereto. A notch 148 is provided at the upper end of the slotted aperture 126 such that the notch 138 on the flap 134 latches the notch 148 to secure the flap 134 within the chamber 119.

Referring to FIGS. 7 through 10, the operation of the foregoing embodiment now will be described. The drinking cup 100 is first slidably positioned through the narrow opening 122 at the narrow end 118 of the frusto-conical shaped body 114 such that the lower portion 103 of the drinking cup 100 is below the narrow end 118 of the frusto-conical shaped body 114. The upper portion 102 of the drinking cup 100 rests above the narrow end 118 of the frusto-conical shaped body 114 and is gripped by the interior of the circumferential shaped sidewall 124, where the lid 104 closes the narrow opening 122 at the narrow end 118 of the frusto-conical shaped body 114 and forms a bottom to the hollow chamber 119 to enable the food to be retained within the hollow chamber 119 of the frusto-conical shaped body 114. The flap 134 is then folded down as described above to prevent the drinking cup 100 and the lid 104 from sliding out of the frusto-conical shaped body 114, where the flap 134 further forms a barrier to cover the inserted straw 105. The straw 105 is inserted through the aperture 130 on the sidewall 124 of the frusto-conical shaped body 114 and through the aperture 132 on the fold-down flap 128 and in the lid 104 and into the drinking cup 100 for drinking the liquid.

In an alternative embodiment, instead of the straw being placed through aperture 130 on the sidewall and then through aperture 132 on fold-down flap 128, in a simplified version, the opening 144 can be large enough to accommodate the straw to be placed directly through the opening. Therefore, instead of having the straw in the opening 130 and retained by the fold-down flap 128 by having the straw also pass through aperture 132, this entire process is eliminated and the straw itself is inserted directly through aperture 144 of the frusto-conical shaped body and then directly into the drinking cup 100 for drinking the liquid.

The present invention conforms to conventional forms of manufacture or any other conventional way known to one skilled in the art, and is of simple construction and is easy to use. By way of example, the apparatus 110 can be made of cardboard material or any other suitable material.

Defined in detail, the present invention is an apparatus for forming a container to retain food and used in conjunction with a drinking cup for retaining liquid and having a lid for covering the drinking cup for retaining the liquid therein, the lid having an opening through which a straw can be inserted for drinking the liquid, the apparatus comprising: (a) a generally frusto-conical shaped body having a narrow end with a narrow opening, a widened end with a wide opening, a hollow chamber located between the wide opening at the widened end and the narrow opening at the narrow end, and a sidewall, the sidewall having a slotted aperture located adjacent to the narrow end and a fold-down flap in the sidewall and located opposite the slotted aperture, and an aperture located adjacent to the widened end and above the fold-down flap for the straw to be inserted therethrough, the fold-down flap folded down and parallel to the narrow opening and having an aperture thereto for directing the straw to be inserted to the opening on the lid; and (b) a flap having a first end with a notch and a second end integrally formed with the widened end of the frusto-conical shaped body such that the flap can be folded downward and into the hollow chamber so that the first end can be inserted into the slotted aperture on the sidewall of the frusto-conical shaped body and secured to the slotted aperture by the notch which latches the slotted aperture; (c) whereby the drinking cup is first slidably positioned through the narrow opening at the narrow end of the frusto-conical shaped body such that the lower portion of the drinking cup is below the narrow end of the frusto-conical shaped body and the upper portion of the drinking cup rests above the narrow end of the frusto-conical shaped body and is gripped by the sidewall, where the lid closes the narrow opening at the narrow end of the frusto-conical shaped body and forms a bottom to the hollow chamber to enable the food to be retained in the hollow chamber and then the flap is folded down as described to prevent the drinking cup and the lid from sliding out of the frusto-conical shaped body and where the flap further forms a barrier to cover the straw which is inserted through the aperture on the sidewall of the frusto-conical shaped body and through the aperture on the fold-down flap and into the opening of the lid and into the drinking cup for drinking the liquid.

Defined broadly, the present invention is an apparatus for forming a container to hold food and used in conjunction with a drinking cup having a lid through which a straw is inserted, the apparatus comprising: (a) a generally frusto-conical shaped body having a bottom end with a bottom opening, a wider top end with a top opening, a chamber between the two openings and a sidewall, the sidewall having an aperture therethrough; and (b) a flap having a first end with retaining means thereon and a second end integrally connected with the wider top end of the frusto-conical shaped body such that the flap can be folded downward and into the chamber so that the first end can be inserted into the aperture on the sidewall of the frusto-conical shaped body and secured thereto by the retaining means on the first end; (c) whereby, the drinking cup is first inserted through the frusto-conical shaped body and through the bottom opening such that a portion of the drinking cup lies below the bottom end of the frusto-conical shaped body and a portion of the drinking cup lies above the bottom end of the frusto-conical shaped body and is gripped by the sidewall at the bottom end, and the lid rests within the frusto-conical shaped body and forms a bottom to the chamber and thereafter the flap is inserted and locked in place as described to thereby prevent the drinking cup and the lid from sliding through the frusto-conical shaped body.

Defined more broadly, the present invention is an apparatus for forming a container to hold food and used in conjunction with a drinking cup having a lid, the apparatus comprising: (a) a generally frusto-conical shaped body having a wider top end with a top opening, a narrower bottom end with a bottom opening, a chamber between the two openings and a sidewall; and (b) panel means having a first end and a second end, the second end attached to the wider top end of the frusto-conical shaped body such that the panel means can be folded downward and into the chamber, where the first end connects to the sidewall of the frusto-conical shaped body; (c) whereby the drinking cup is first inserted through the frusto-conical shaped body and through the bottom opening such that a portion of the drinking cup lies below the bottom end of the frusto-conical shaped body and a portion of the drinking cup rests above the bottom end of the frusto-conical shaped body and is gripped by the sidewall at the location of the bottom opening and the lid rests within the frusto-conical shaped body and forms a bottom to the chamber and the panel means is folded within the chamber to retain the drinking cup and the lid in its position and prevent the drinking cup and the lid from sliding out of the frusto-conical shaped body.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An apparatus for forming a container to hold food and used in conjunction with a drinking cup having a lid, the apparatus comprising:

a generally frusto-conical shaped body having a wider top end with a top opening, a narrower bottom end with a bottom opening, a chamber between the two openings and a sidewall; and b. panel means having a first end and a second end, the second end attached to said wider top end of said frusto-conical shaped body such that the panel means can be folded downward and into said chamber, where the first end connects to said sidewall of said frusto-conical shaped body;

c. whereby the drinking cup is first inserted through said frusto-conical shaped body and through said bottom opening such that a portion of the drinking cup lies below said bottom end of said frusto-conical shaped body and a portion of the drinking cup rests above said bottom end of said frusto-conical shaped body and is gripped by said sidewall at the location of said bottom opening and the lid rests within said frusto-conical shaped body and forms a bottom to said chamber and said panel means is folded within said chamber to retain the drinking cup and the lid in its position and prevent the drinking cup and the lid from sliding out of said frusto-conical shaped body.

2. The apparatus in accordance with claim 1 further comprising a slotted aperture on said sidewall of said frusto-conical shaped body.

3. The apparatus in accordance with claim 2 wherein said first end of said panel means includes a notch which latches said slotted aperture on said sidewall of said frusto-conical shaped body for securing said panel means within said chamber of said frusto-conical shaped body.

4. The apparatus in accordance with claim 2 further comprising a fold-down flap in said sidewall and located opposite said slotted aperture on said sidewall, the fold-down flap folded down and parallel to the lid and having an aperture thereto for directing a straw to be inserted through the lid of the drinking cup for drinking the liquid.

5. The apparatus in accordance with claim 4 further comprising an aperture on said sidewall of said frusto-conical shaped body and located adjacent to said wider top end and above said fold-down flap for the straw to be inserted therethrough.

6. The apparatus in accordance with claim 1 further comprising an aperture on said wider top end of said frusto-conical shaped body for the straw to be inserted therethrough and into the lid of the drinking cup for drinking the liquid.

7. The apparatus in accordance with claim 4 wherein said panel means further serves to provide a barrier to cover the straw and to prevent the food from exiting out from an opening created by said fold-down flap.

8. An apparatus for forming a container to hold food and used in conjunction with a drinking cup having a lid through which a straw is inserted, the apparatus comprising:

a. a generally frusto-conical shaped body having a bottom end with a bottom opening, a wider top end with a top opening, a chamber between the two openings and a sidewall, the sidewall having an aperture therethrough; and b. a flap having a first end with retaining means thereon and a second end integrally connected with said wider top end of said frusto-conical shaped body such that the flap can be folded downward and into said chamber so that the first end can be inserted into said aperture on said sidewall of said frusto-conical shaped body and secured thereto by the retaining means on the first end;

c whereby, the drinking cup is first inserted through said frusto-conical shaped body and through said bottom opening such that a portion of the drinking cup lies below said bottom end of said frusto-conical shaped body and a portion of the drinking cup lies above said bottom end of said frusto-conical shaped body and is gripped by said sidewall at said bottom end, and the lid rests within said frusto-conical shaped body and forms a bottom to said chamber and thereafter said flap is inserted and locked in place as described to thereby prevent the drinking cup and the lid from sliding through said frusto-conical shaped body.

9. The apparatus in accordance with claim 8 further comprising a fold-down flap located in said sidewall and opposite said aperture on said sidewall, the fold-down flap folded down and parallel to the lid and having an aperture thereto for directing the straw to be inserted through the lid of the drinking cup for drinking the liquid.

10. The apparatus in accordance with claim 9 further comprising an aperture on said sidewall of said frusto-conical shaped body and located adjacent to said wider top end and above said fold-down flap for the straw to be inserted therethrough and into the lid of the drinking cup for drinking the liquid.

11. The apparatus in accordance with claim 8 further comprising an aperture on said wider top end of said frusto-conical shaped body for the straw to be inserted therethrough and into the lid of the drinking cup for drinking the liquid.

12. The apparatus in accordance with claim 8 wherein said retaining means on said first end of said flap includes a notch which latches said aperture on said sidewall of said frusto-conical shaped body for securing said flap within said chamber of said frusto-conical shaped body.

13. The apparatus in accordance with claims 8 wherein said flap further serves to provide a barrier to cover the straw and to prevent the food from exiting out from an opening created by said fold-down flap.

14. An apparatus for forming a container to retain food and used in conjunction with a drinking cup for retaining liquid and having a lid for covering the drinking cup for retaining the liquid therein, the lid having an opening through which a straw can be inserted for drinking the liquid, the apparatus comprising:

a. a generally frusto-conical shaped body having a narrow end with a narrow opening, a widened end with a wide opening, a hollow chamber located between the wide opening at the widened end and the narrow opening at the narrow end, and a sidewall, the sidewall having a slotted aperture located adjacent to the narrow end and a fold-down flap in the sidewall and located opposite the slotted aperture, and an aperture located adjacent to the widened end and above the fold-down flap for the straw to be inserted therethrough, the fold-down flap folded down and parallel to the narrow opening and having an aperture thereto for directing the straw to be inserted to the opening on the narrow opening; and b. a flap having a first end with a notch and a second end integrally formed with said widened end of said frusto-conical shaped body such that the flap can be folded downward and into said hollow chamber so that the first end can be inserted into said slotted aperture on said sidewall of said frusto-conical shaped body and secured to said slotted aperture by the notch which latches said slotted aperture;

c. whereby the drinking cup is first slidably positioned through said narrow opening at said narrow end of said frusto-conical shaped body such that the lower portion of the drinking cup is below said narrow end of said frusto-conical shaped body and the upper portion of the drinking cup rests above said narrow end of said frusto-conical shaped body and is gripped by said sidewall, where the lid closes said narrow opening at said narrow end of said frusto-conical shaped body and forms a bottom to said hollow chamber to enable the food to be retained in said hollow chamber and then said flap is folded down as described to prevent the drinking cup and the lid from sliding out of said frusto-conical shaped body and where said flap further forms a barrier to cover the straw which is inserted through said aperture on said sidewall of said frusto-conical shaped body and through said aperture on said fold-down flap and into the opening of the lid and into the drinking cup for drinking the liquid.

15. The apparatus in accordance with claim 14 wherein said frusto-conical shaped body is disposable.

* * * * *